US009897973B2

(12) United States Patent
Stranczl

(10) Patent No.: US 9,897,973 B2
(45) Date of Patent: Feb. 20, 2018

(54) PIVOTING ASSEMBLY FOR A TIMEPIECE

(71) Applicant: Nivarox-FAR S.A., Le Locle (CH)

(72) Inventor: Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/046,810

(22) Filed: Feb. 18, 2016

(65) Prior Publication Data

US 2016/0266549 A1 Sep. 15, 2016

(30) Foreign Application Priority Data

Mar. 9, 2015 (EP) ..... 15158296

(51) Int. Cl.

| | |
|---|---|
| ***G04B 31/00*** | (2006.01) |
| ***G04B 13/02*** | (2006.01) |
| ***G04B 15/14*** | (2006.01) |
| ***G04B 17/32*** | (2006.01) |
| ***G04B 31/02*** | (2006.01) |
| ***G04B 31/04*** | (2006.01) |
| ***G04B 31/06*** | (2006.01) |

(52) U.S. Cl.

CPC ..... *G04B 31/00* (2013.01); *G04B 13/021* (2013.01); *G04B 13/026* (2013.01); *G04B 15/14* (2013.01); *G04B 17/32* (2013.01); *G04B 31/02* (2013.01); *G04B 31/04* (2013.01); *G04B 31/06* (2013.01)

(58) Field of Classification Search

CPC .... G04B 13/021; G04B 13/026; G04B 15/14; G04B 17/32; G04B 31/02; G04B 31/04; G04B 31/06

See application file for complete search history.

(56) References Cited

U.S. PATENT DOCUMENTS

| | | | | |
|---|---|---|---|---|
| 996,499 A * | 6/1911 | Marshall | G04B 1/16 | 368/143 |
| 1,981,297 A * | 11/1934 | Aegler | G04B 1/20 | 368/208 |
| 2,108,776 A * | 2/1938 | McNicoll | G04B 15/00 | 368/127 |
| 2,733,567 A * | 2/1956 | Zellweger | G04B 37/10 | 277/402 |

(Continued)

FOREIGN PATENT DOCUMENTS

| | | |
|---|---|---|
| CH | 698 675 B1 | 9/2009 |
| CH | 699 680 A2 | 4/2010 |

(Continued)

OTHER PUBLICATIONS

Klein, Eric, Translation of CH699680, originally published on Apr. 15, 2010, full document.*

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A pivoting assembly includes an arbor rotatably mounted between two bearings, a member mounted between a shoulder of the arbor and a resilient washer, at least one of the two bearings including a limit stop which is arranged to enter into direct contact with the resilient washer in order to restrict the relative movement between the arbor and its bearings.

12 Claims, 3 Drawing Sheets

(56) References Cited

U.S. PATENT DOCUMENTS 3,080,702 A * 3/1963 Schneiter ..... G04C 23/16 200/38 A
3,396,450 A * 8/1968 Faehndrich ..... G04B 17/345 264/279.1
3,408,809 A * 11/1968 Dumont ..... G04B 17/34 368/177
4,318,017 A * 3/1982 Migeon ..... H02K 1/2793 310/156.16
2010/0238769 A1* 9/2010 Zaugg ..... G04B 17/285 368/127
2013/0188462 A1* 7/2013 Helfer ..... G04B 31/02 368/326
2013/0223194 A1* 8/2013 Cattin ..... G04B 1/16 368/143
2014/0160902 A1 6/2014 Cusin et al.
2014/0204719 A1* 7/2014 Rochat ..... G04B 1/16 368/141
2014/0328150 A1* 11/2014 Boulenguiez ..... G04B 17/26 368/130
2014/0376338 A1* 12/2014 Kaelin ..... G04B 1/145 368/130
2015/0098310 A1 4/2015 Stranczl et al.
2015/0098311 A1 4/2015 Stranczl et al.
2015/0253733 A1* 9/2015 Stranczl ..... G04B 17/32 368/177
2015/0286188 A1* 10/2015 Dubois ..... G04B 13/026 368/322

FOREIGN PATENT DOCUMENTS

CH EP 2977834 A2 * 1/2016 ..... G04B 31/0082
EP 2 743 781 A1 6/2014
EP 2 746 868 A1 6/2014

OTHER PUBLICATIONS

European Search Report dated Oct. 29, 2015 in European Application 15158296, filed on Mar. 9, 2015 ( with English Translation).

* cited by examiner

PIVOTING ASSEMBLY FOR A TIMEPIECE

This application claims priority from European Patent Application No. 15158296.2 filed Mar. 9, 2015, the entire disclosure of which is hereby incorporated herein by reference.

FIELD OF THE INVENTION

The invention relates to a pivoting assembly for a timepiece and, more particularly, to a gear train or to a resonator for a timepiece.

BACKGROUND OF THE INVENTION

US Patent Applications 2015/098310 and 2015/098311 disclose a balance spring resiliently locked on an arbor by a washer. This type of configuration avoids having to fit the balance spring collet onto an arbor and then bonding it at its points of contact.

However, the use of such a washer results in a total height which makes it impossible to implement in movements of small thickness.

SUMMARY OF THE INVENTION

It is an object of the present invention to overcome all or part of the aforecited drawbacks by proposing a pivoting assembly using a resilient washer disclosed in one of US Patent Applications 2015/098310 and 2015/098311 which includes a total thickness allowing the application thereof to any type of timepiece movement.

To this end, the invention relates to a pivoting assembly comprising an arbor rotatably mounted between two bearings, a member mounted on the arbor with the aid of at least one resilient washer, characterized in that at least one of the two bearings comprises a limit stop which is arranged to enter into direct contact with said at least one resilient washer in order to restrict the relative movement between the arbor and the two bearings.

It is thus understood that all or part of the extra height due to the use of said at least one resilient washer is compensated by replacing the shoulder formed on the arbor by the upper surface of said at least one washer. Thus, the limit stop of at least one of the bearings acts directly against the resilient washer and no longer against the arbor in order to restrict the relative movement between the arbor and its bearings.

In accordance with other advantageous variants of the invention:

- said member is mounted between a shoulder of the arbor and said at least one resilient washer;
- said member is mounted on the arbor between two resilient washers;
- said member is a balance spring and, preferably a balance and a roller are also mounted on the arbor;
- said member is a wheel and, preferably, a pinion is also mounted on the arbor;
- said member is a pallet lever, a detent, a mainspring or a balance;
- the two bearings each include at least one jewel arranged to receive a pivot formed on each end of the arbor;
- each at least one jewel is resiliently mounted in its associated bearing in order to dampen shocks received by the arbor;
- the two bearings are respectively mounted in a plate and a bridge.

Moreover, the invention relates to a timepiece comprising at least one pivoting assembly according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
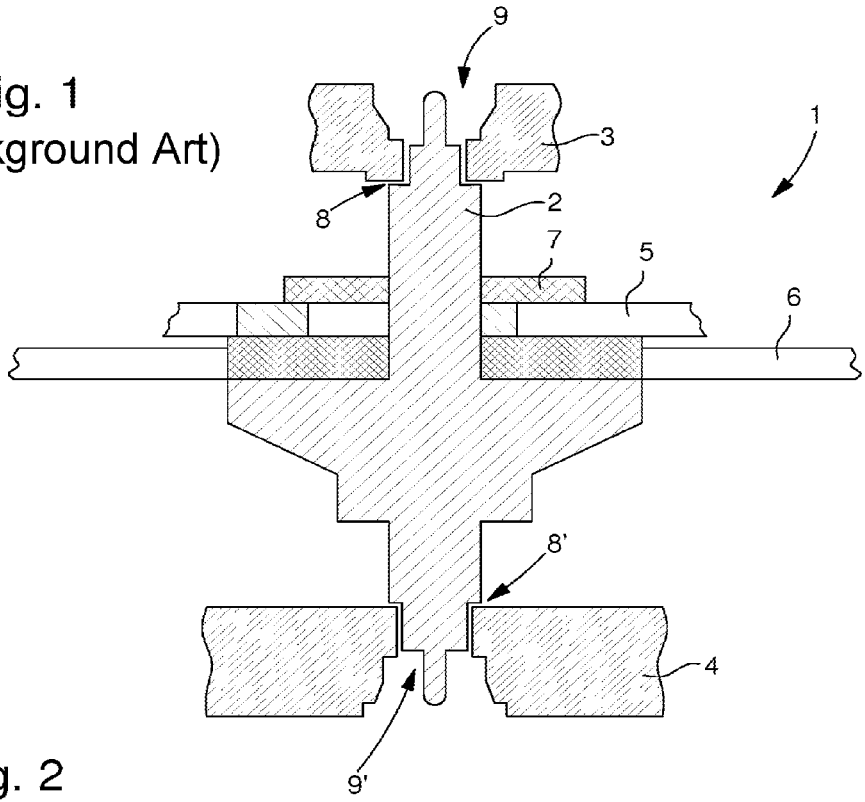
Fig. 1 (Background Art)
FIG. 1 is a view of a regulating member using a resilient washer.

US Patent Applications 2015/098310 and 2015/098311, incorporated by reference in the present description, disclose a balance spring resiliently locked between the shoulder of an arbor and a resilient washer. One such configuration is shown in FIG. 1. There is shown a regulating member 1 formed of an arbor 2 mounted between a bridge 3 and a plate 4. Regulating member 1 includes a balance spring 5 and a balance 6 which are mounted between a shoulder of arbor 2 and a resilient washer 7.

Arbor 2 further includes two shoulders 8, 8' each intended to enter into contact with a bearing 9, 9' respectively mounted in bridge 3 and plate 4. It is evident that the configurations described in US Patent Applications 2015/098310 and 2015/098311 require a significant distance between resilient washer 7 and bearing 9 which may make them impossible to implement in a movement of small thickness.

To compensate for this extra thickness of the resilient washer, the invention relates to a pivoting assembly comprising an arbor rotatably mounted between two bearings and a member mounted on the arbor with the aid of at least one resilient washer. Advantageously according to the invention, at least one of the two bearings includes a limit stop which is arranged to enter into direct contact with said at least one resilient washer in order to restrict the relative movement between the arbor and its bearings.

It is thus understood that all or part of the extra height due to the use of a resilient washer is compensated by replacing the specially formed shoulder on the arbor by the upper surface of said at least one washer. Thus, the limit stop of at least one of the bearings acts directly against the resilient washer and no longer against the arbor in order to restrict the relative movement between the arbor and its bearings.

It is also understood that an arbor may also comprise at least two resilient washers, either attaching a single member, or each resilient washer attaching a distinct member against a distinct shoulder of the arbor. Advantageously, this means that each of the two bearings can enter into direct contact with one of the resilient washers used on the arbor in order to restrict the relative movement between the arbor and its bearings while minimising the height of the pivoting assembly.

Figure 2:
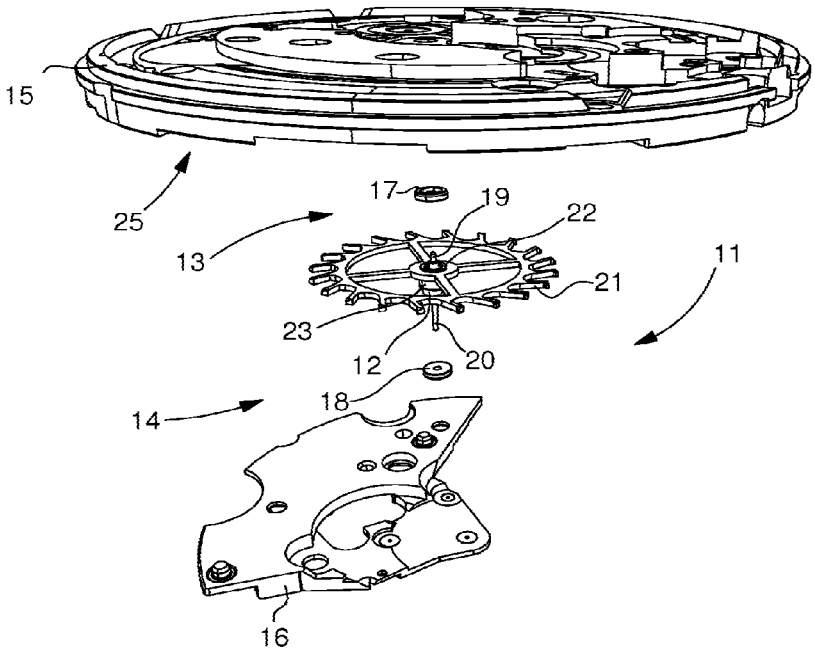
FIG. 2 is a view of a first embodiment of the invention.

For better comprehension of the invention, FIG. 2 relates to a first embodiment forming a gear train type pivoting assembly. Pivoting assembly 11 comprises an arbor 12 rotatably mounted between two bearing assemblies 13 and 14 respectively mounted in a plate 15 and a bridge 16. In the example illustrated in FIG. 2, each bearing assemblies 13, 14 comprises a jewel or jewel hole 17, 18 arranged to receive a pivot 19, 20 formed on each end of arbor 12.

As seen in FIG. 2, a member forming a wheel 21 is mounted between a shoulder of arbor 12 and a resilient washer 22. It can also be seen that arbor 12 comprises a pinion 23 underneath wheel 21. Advantageously according to the invention, at least one of the two bearing assemblies 13, 14 comprises a limit stop 25, which is arranged to enter into direct contact with resilient washer 22 in order to restrict the relative movement between arbor 12 and its bearing assemblies 13, 14.

Figure 3:
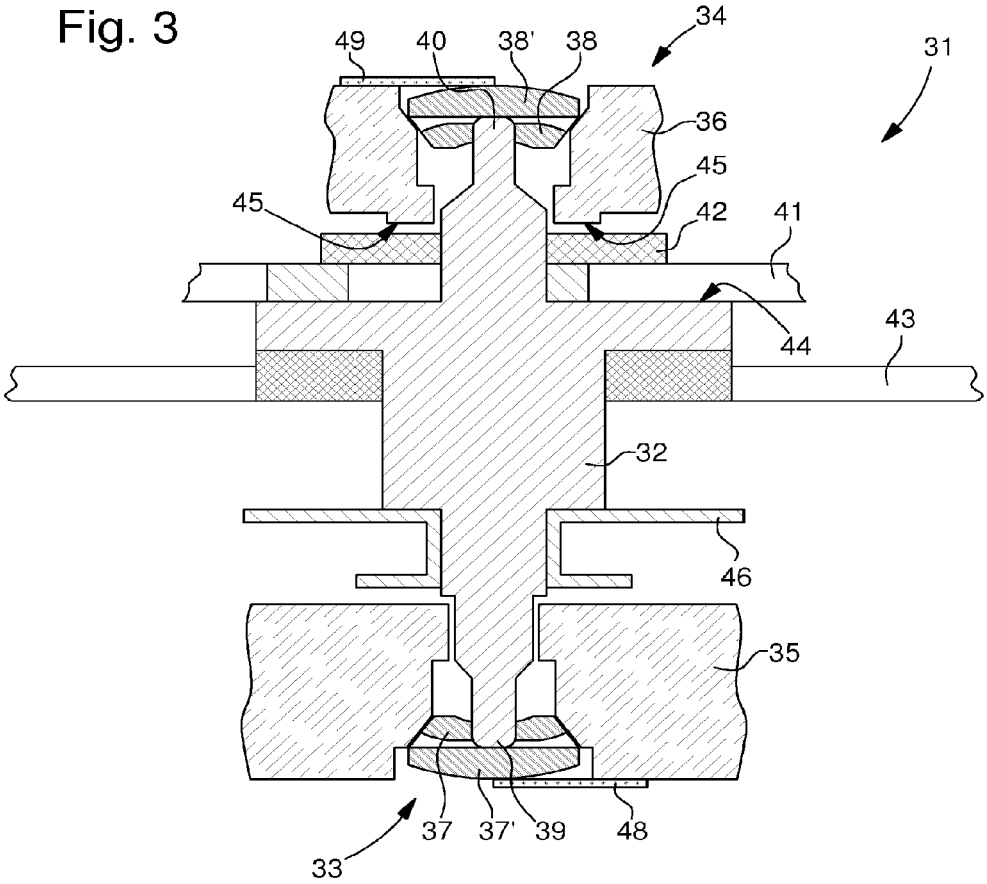
FIGS. 3 and 4 are views of a second embodiment of the invention.
Figure 4:
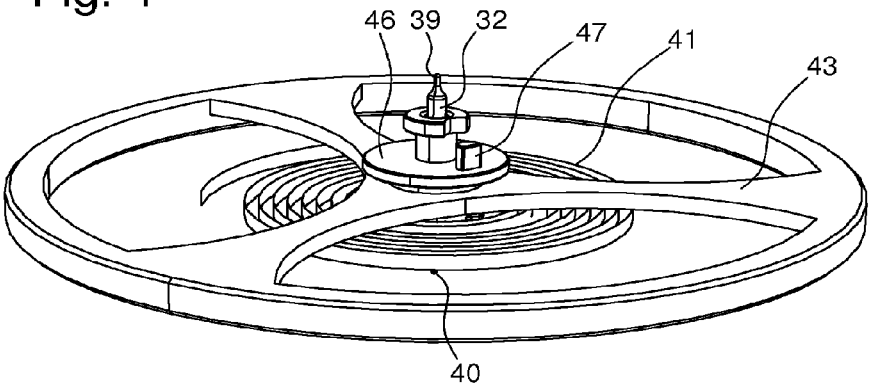

The second embodiment shown in FIGS. 3 and 4 better illustrates the limit stops according to the invention. Thus, FIGS. 3 and 4 relate to a second embodiment forming a resonator type pivoting assembly. Pivoting assembly 31 comprises an arbor 32 rotatably mounted between two bearing assemblies 33 and 34 respectively mounted in a plate 35 and a bridge 36. In the example illustrated in FIG. 3, each bearing assembly 33, 34 comprises at least one jewel or jewel hole 37, 38 and, preferably, a jewel 37, 38—endstone 37', 38' assembly arranged to receive a pivot 39, 40 formed on each end of arbor 32.

As seen in FIGS. 3 and 4, a member forming a balance spring 41 is mounted between a shoulder 44 of arbor 32 and a resilient washer 42. It can also be seen that arbor 32 comprises a balance 43 and a roller 46 provided with an impulse pin 47. Advantageously according to the invention, at least one of the two bearing assemblies 33, 34 comprises a limit stop 45, which is arranged to enter into direct contact with resilient washer 42 in order to restrict the relative movement between arbor 32 and its bearing assemblies 33, 34.

As seen in FIG. 3, it can also be seen that each at least one jewel 37, 38 and preferably, a jewel 37, 38—endstone 37', 38' assembly, is resiliently mounted in its associated bearing assembly 33, 34 in order to dampen shocks received by arbor 32. In the example of FIG. 3, resilience is provided by a lyre-shaped spring 48, 49 respectively mounted between plate 35 and endstone 37', and bridge 36 and endstone 38'.

Figure 5:
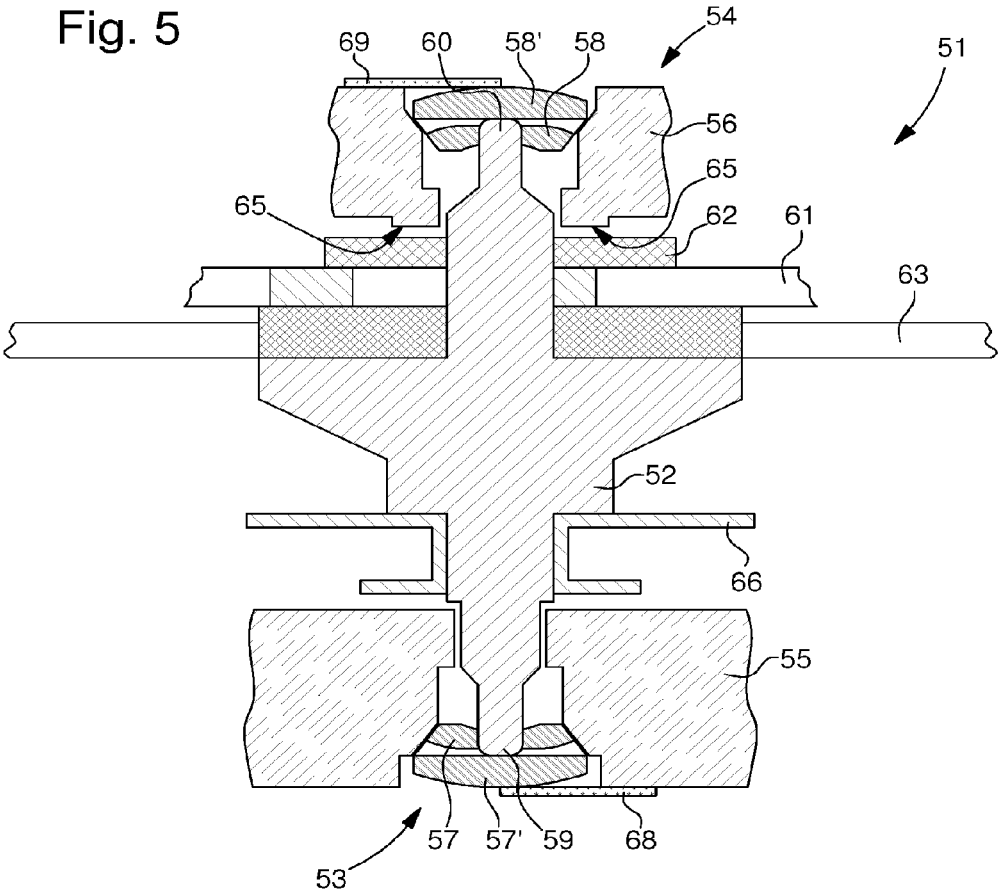
FIG. 5 is a view of a third embodiment of the invention.

FIG. 5 relates to a third embodiment forming an alternative resonator type pivoting assembly to the second embodiment. Pivoting assembly 51 comprises an arbor 52 rotatably mounted between two bearing assemblies 53 and 54 respectively mounted in a plate 55 and a bridge 56. In the example illustrated in FIG. 5, each bearing assembly 53, 54 comprises at least one jewel or jewel hole 57, 58 and, preferably, a jewel 57, 58—endstone 57', 58' assembly arranged to receive a pivot 59, 60 formed on each end of arbor 52.

As seen in FIG. 5, a member forming a balance spring 61 is mounted between a shoulder of arbor 52 via a balance 63 and a resilient washer 62. It can also be seen that arbor 52 comprises a roller 66 provided with an impulse pin. Advantageously according to the invention, at least one of the two bearing assemblies 53, 54 comprises a limit stop 65, which is arranged to enter into direct contact with resilient washer 62 in order to restrict the relative movement between arbor 52 and its bearing assemblies 53, 54.

As shown in FIG. 5, it can also be seen that each at least one jewel 57, 58 and preferably, a jewel 57, 58—endstone 57', 58' assembly, is resiliently mounted in its associated bearing assembly 53, 54 in order to dampen shocks received by arbor 52. In the example of FIG. 5, resilience is provided by a lyre-shaped spring 68, 69 respectively mounted between plate 55 and endstone 57', and bridge 56 and endstone 58'.

Regardless of the embodiment, it is thus understood that all or part of the extra height due to the use of resilient washer 22, 42, 62 is compensated by replacing the shoulder 8 formed on arbor 2 (illustrated in FIG. 1) by the upper surface of resilient washer 22, 42, 62. Thus, limit stop 25, 45, 65 of at least one of bearing assemblies 13, 14, 33, 34, 53, 54 acts directly against resilient washer 22, 42, 62 and no longer against arbor 12, 32, 52 in order to restrict the relative movement between arbor 12, 32, 52 and its bearing assemblies 13, 14, 33, 34, 53, 54.

Of course, this invention is not limited to the illustrated example but is capable of various variants and modifications which will appear to those skilled in the art. In particular, other members may be mounted instead of or in addition to the members cited below. By way of non-limiting example, said member or an additional member could thus be an escapement lever, a detent escapement, a mainspring of a barrel or striking mechanism, or even a balance.

It is also possible to envisage an arbor comprising two resilient washers, each attaching a distinct member to one end of the arbor, each limit stop of one of the two arbor bearings being arranged to enter into direct contact with one of the two resilient washers in order to restrict the relative movement between the arbor and its bearings.

Finally, in a non-limiting manner, in a last embodiment, the pivoting assembly could also comprise a member formed, for example, of at least one lever of a pallets mounted on an arbor (also called a staff) between two resilient washers. The limit stop of each of the two bearings respectively mounted in a plate and in a bridge are preferably arranged to enter into contact with one of the resilient washers in order to restrict the relative movement between the arbor and its bearings. The member may also comprise pallet-stones, a fork and a guard pin, each of which may be integral with the pallet lever or simply fixed to the pallet lever.

What is claimed is:

1. A pivoting assembly comprising:

two bearing assemblies one of which includes a bridge housing a bearing;

an arbor rotatably mounted between the two bearing assemblies, the arbor having a longitudinal axis, and a member mounted on the arbor with an aid of at least one resilient washer which is in direct contact with the arbor, wherein the bridge comprises a limit stop which protrudes from a surface of the bridge toward the at least one resilient washer and is arranged to enter into direct contact with the at least one resilient washer along the longitudinal axis in order to restrict the relative movement between the arbor and the one of the two bearing assemblies.

2. The pivoting assembly according to claim 1, wherein the member is mounted between a shoulder of the arbor and the at least one resilient washer.

3. The pivoting assembly according to claim 1, wherein the member is mounted on the arbor between two resilient washers.

4. The pivoting assembly according to claim 1, wherein the member is a balance spring.

5. The pivoting assembly according to claim 4, wherein a balance and a roller are also mounted on the arbor.

6. The pivoting assembly according to claim 1, wherein the member is a wheel.

7. The pivoting assembly according to claim 6, wherein a pinion is also mounted on the arbor.

8. The pivoting assembly according to claim 1, wherein the member is a balance.

9. The pivoting assembly according to claim 1, wherein the two bearing assemblies each include at least one jewel arranged to receive a pivot formed on each end of the arbor.

10. The pivoting assembly according to claim 9, wherein each at least one jewel is resiliently mounted in the associated bearing assembly in order to dampen shocks received by the arbor.

11. The pivoting assembly according to claim 1, wherein the two bearing assemblies are respectively mounted in a plate and a bridge.

12. A timepiece including at least one pivoting assembly according to claim 1.

* * * * *